US005389064A

United States Patent [19]

Cohen

[11] Patent Number: 5,389,064

[45] Date of Patent: Feb. 14, 1995

[54] ORTHOPEDIC CUSHION

[76] Inventor: Gideon Cohen, 20 Eshel Street, Omer 84965, Israel

[21] Appl. No.: 978,486

[22] Filed: Nov. 19, 1992

Related U.S. Application Data

[63] Continuation-in-part of Ser. No. 731,734, Jul. 16, 1991, abandoned.

[30] Foreign Application Priority Data

Aug. 1, 1990 [IL] Israel ..... 95262

[51] Int. Cl.[6] ..... A47C 20/04; A61F 5/02

[52] U.S. Cl. ..... 602/19; 602/1; 5/633; 5/634; 5/657; 128/845; 297/284.5

[58] Field of Search ..... 602/1, 19; 128/845; 5/633, 634, 657, 652, 653; 297/232, 233, 283, 337, 230.11, 230.12, 284.1, 284.4, 284.5, 284.8; 606/237, 238, 239, 240, 241

[56] References Cited

U.S. PATENT DOCUMENTS

| | | | |
|---|---|---|---|
| 1,667,626 | 4/1928 | Epstein . | |
| 2,591,306 | 4/1952 | Sherman | 297/284.5 |
| 3,763,509 | 10/1973 | Mittendorf . | |
| 4,339,150 | 7/1982 | McNamara et al. | 297/284.8 |
| 4,516,568 | 5/1985 | Baxter et al. | 297/284.5 X |
| 4,597,386 | 7/1986 | Goldstein . | |
| 4,635,622 | 1/1987 | Berube . | |
| 4,752,982 | 6/1988 | Jones et al. . | |
| 4,754,507 | 7/1988 | Edge | 5/633 |
| 4,930,171 | 6/1990 | Frantz . | |
| 4,970,742 | 11/1990 | Keener | 5/633 |
| 5,171,209 | 12/1992 | Gamba | 602/19 X |

FOREIGN PATENT DOCUMENTS

| | | |
|---|---|---|
| 785087 | 6/1972 | Belgium . |
| 1159582 | 12/1983 | Canada . |
| 3821018 | 1/1989 | Germany . |

*Primary Examiner*—Stephen R. Crow
*Assistant Examiner*—Beverly A. Meindl
*Attorney, Agent, or Firm*—Merchant, Gould, Smith, Edell, Welter & Schmidt

[57] ABSTRACT

An orthopedic cushion for supporting the back when sitting comprising a cushion assembly and a rear support is disclosed. The cushion assembly has a front outer surface and a stiffening backbone that is essentially curved in cross section in a plane perpendicular to the front outer surface. The backbone is also provided with spaced zones. The rear support has an upper portion and a lower portion and is foldable about a zone interposed between the upper and lower portions. Means is provided for removably connecting the upper and lower portions to the spaced zones of the backbone.

7 Claims, 11 Drawing Sheets

ORTHOPEDIC CUSHION

This is a continuation-in-part of application Ser. No. 07/731,734, filed 16 Jul. 1991, now abandoned.

FIELD OF THE INVENTION

The present invention relates to orthopedic cushions. More specifically, to a cushion for supporting the back when the user is sitting in a chair.

BACKGROUND OF THE INVENTION

It is known that many persons suffer discomfort and pain in their back at different stages of life, and many attempts have been made in the art to provide chairs, armchairs, vehicle seats and the like which support the back of the person sitting in them, in such a way as to alleviate the aforesaid discomfort and pain. Properly supporting the back when sitting is useful to healthy persons as well, to prevent the development of a complaint with the passing of time. However, seats having a properly designed back are not always available, and even when they are, their design may be suitable for certain persons and unsuitable for others. German Patent No. 1654203 is directed to a cushion which can be positioned in the middle portion of the back of a seat, which has a convex configuration and lacks a backbone. This configuration does not provide effective and comfortable support for the lower part of the back.

It is a purpose of this invention to provide means whereby a person may enjoy a satisfactory back support, even when sitting in a chair, armchair or other seats which are not designed to provide such support.

More specifically, it is a purpose of this invention to provide a portable cushion which can be used in connection with any seats, and provide the desired back support.

It is a further purpose of this invention to provide an orthopedic cushion having an adjustable geometry, to permit fitting it to different seats and different users.

Other purposes and advantages of the invention will become apparent as the description proceeds.

SUMMARY OF THE INVENTION

The cushion according to this invention comprises a front having a surface which comes into contact with the user's back when the cushion is in use, and is characterized in that it comprises an essentially rigid, stiffening element (hereinafter called "backbone" of the cushion) having a configuration that is essentially curved in cross-section in a plane perpendicular to said front surface, and means for defining the geometry of the cushion in cross-section in the plane of symmetry thereof, which is also the plane of symmetry of its front surface and the plane of symmetry of the backbone itself. The backbone generally has a front surface that is parallel to the cushion front surface, so that any plane that is perpendicular to one of them is also perpendicular to the other. Since when the cushion is placed on a seat, the said plane perpendicular to its front surface is approximately horizontal and the said plane of symmetry is approximately vertical, the words "horizontal" and "vertical" will sometimes be used to refer to said planes and should be so construed.

The cushion according to the invention preferably further comprises at least an element (hereinafter called the "front element") which is interposed between said backbone and the front surface of the cushion coming into contact with the user's back. Said backbone is preferably constituted by a board of a suitable rigid material, such as plywood, rigid plastic, or the like, which is bent in a horizontal plane and is preferably essentially straight in vertical cross-section. Said front element may conveniently be made of cellular elastomeric material, such as expanded polyurethane or foam rubber or the like.

Preferably the cushion according to the invention has a substantially wedge-shaped configuration in cross-section in its plane of symmetry, viz. it is wider at the bottom than at the top so as to provide a slanted surface on which the back of the user rests when the cushion is placed on a chair, armchair, vehicle seat or the like, in contact with the back thereof. As a result of said configuration, the cushion backbone, when in use, acquires a slant towards the back, with respect to the vertical, which is desirable and anatomically useful. Wedge-shaped includes substantially triangular configurations and trapezoidal configurations having one very short side.

In an embodiment of the invention the means defining the geometry of the cushion comprises a rigid or an elastic element (hereinafter called the "rear element") which is interposed between the backbone and the surface of the cushion coming into contact with the back of the seat on which the cushion is placed, and which may be made of plywood, rigid plastic or cellular elastomeric material, which may be different from the material of which the front element is made.

Preferably, the cushion is provided with a cover of a suitable fabric or other sheet material, which may also have the task of keeping the elements of the cushion in assembled relationship.

In a preferred embodiment of the invention, the means for defining the geometry of the cushion are means for adjusting its shape in cross-section in its plane of symmetry, particularly to adjust the angle which defines the aperture of the wedge. In said adjustment, the slant of the backbone is also preferably modified. Said adjusting means may act to adjust the width of the cushion in a given horizontal plane, viz. its thickness, preferably near the bottom thereof, the geometry of the cushion and its vertex angle - viz. the angle between the two longer, sub-vertical sides of its trapezoidal cross-section-being modified as a consequence of said adjustment.

In another preferred embodiment, the aforesaid adjusting means comprise a spacer, which is also essentially rigid, and which is adapted to bear, directly or through the interposition of a rear element, against the back of the seat on which the cushion is placed, and means for adjusting the distance between it and the backbone. They preferably comprise means for allowing the backbone to vary its slant with respect to the vertical, as said distance is adjusted. In this embodiment, however, the rear element may be omitted altogether.

In a further, particularly preferred embodiment, the cushion according to the invention comprises a cushion assembly and a rear support, the cushion assembly comprising a front the outer surface of which comes into contact with the user's back when the cushion is in use, an essentially rigid, stiffening backbone, having a configuration that is essentially curved in cross-section in a plane perpendicular to said front surface of said cushion assembly, said rear support comprising at least two portions, means being provided for removably connecting said two portions to spaced zones of said backbone, said two portions of said rear support being preferably foldable about a zone interposed between said two portions. Preferably said two portions are located one below the other when the cushion is in use, and therefore can be called "upper" and "lower" portion, said spaced zones are provided in pairs, the zones of each pair being symmetrically located with respect to the plane of symmetry of the cushion assembly front surface, the zones of each of said pairs are vertically spaced from the zones of the other pair and are provided with seats, and said upper and lower portions of said rear support are provided with means for engaging said seats; and more preferably a plurality of said seats is provided in at least one pair of said spaced zones and are selectively engageable by said engaging means of said rear support. Still more preferably said upper portion of said rear support has upper anchoring bars and said lower portion has lower anchoring bars, and said backbone is provided in its rear face with upper anchoring grooves and lower anchoring grooves located in said pairs of spaced zones, said upper anchoring grooves being engaged by said upper anchoring bars of said upper portion of said rear support when the cushion is in use and said lower grooves being engaged by said lower anchoring bars of said lower portion of said rear support when the cushion is in use.

DESCRIPTION OF THE DRAWINGS

The invention will be better understood from the description of four preferred embodiments, with reference to the attached drawings, wherein.

DETAILED DESCRIPTION OF PREFERRED EMBODIMENTS

Figure 1:
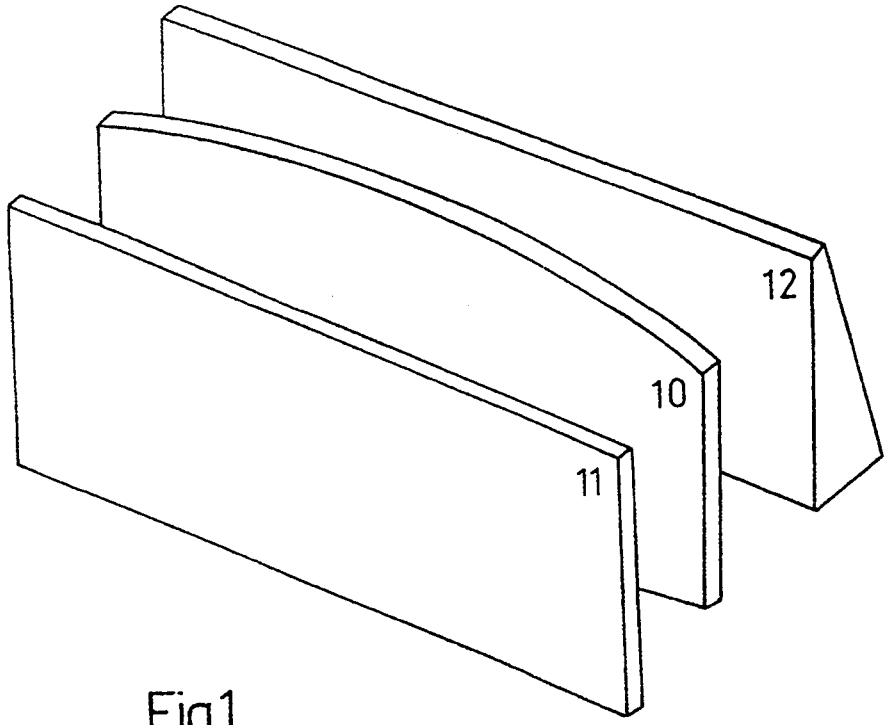
FIG. 1 is an exploded perspective view of a cushion according to an embodiment of the invention, its cover being omitted.
Figure 2:
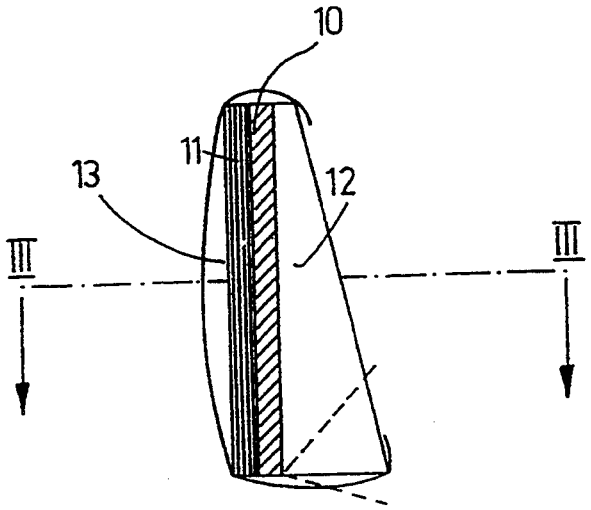
FIG. 2 is a cross-section of said cushion in its plane of symmetry.
Figure 3:
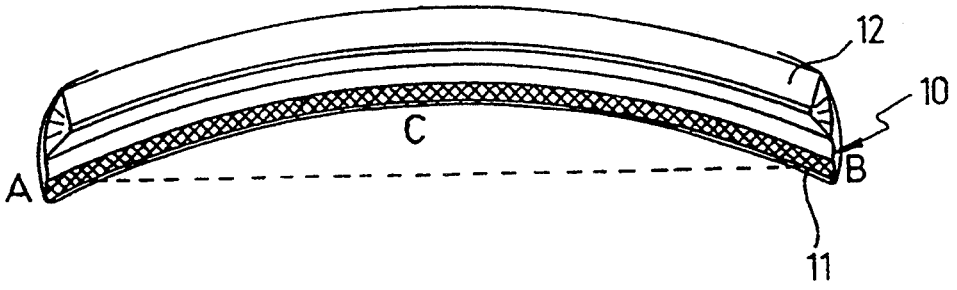
FIG. 3 is a cross-section of said cushion taken on plane III—III of FIG. 2 perpendicular to its front surface.

With reference now to FIGS. 1 to 3, a cushion according to an embodiment of the invention is composed essentially of three elements: a backbone 10, consisting of a board of plywood or other rigid sheet material, a front element 11 of foamed elastic material, e.g. expanded polyurethane or the like, which is interposed between the backbone 10 and the cover 13 of the cushion (omitted in FIG. 1) and a rear element 12, which is preferably wedge-shaped as shown in the drawing and may also be made of foamed elastic material, which may be the same as that of front element 11, or may be different, or may be made of a rigid material as plywood, rigid plastic or even metal. As seen, the backbone has the shape of a sector of a cylinder, viz. is straight in vertical cross-section and curved, preferably similar to an arc of a circle in horizontal cross-section. It has been found that for the cushion to perform its orthopedic function, the curvature of the backbone 10 in a horizontal plane must be comprised between certain limits. These limits may be defined by tracing a chord between two points A and B, (FIG. 3) which are symmetrically located with respect to the center point C of the backbone cross-section and are spaced from one another by 300 mm, and measuring the distance between the center point C and the chord. Said distance should be comprised between 0 and 100 mm, and preferably between 5 and 50 mm, a convenient value being, e.g., 35 mm. The actual width of the backbone, of course, need not be 300 mm, this length being used only to define the backbone curvature, but may be varied as desired, though in general the width of the cushion will be comprised between 10 and 25 cm and preferably between 5 and 10 cm.

When the three elements are assembled in a cushion, the elastic elements 11 and 12, held by cover 13 in assembled relationship with backbone 10, will bend and follow the curvature of the backbone, as shown in horizontal cross-section in FIG. 3.

The cushion shown in FIGS. 1 to 3 has a substantially horizontal bottom side, viz. a flat bottom side that is substantially perpendicular to its front surface. However it is possible, and in many cases desirable, that the bottom of the cushion be provided with a slanted surface which makes an angle, e.g. of 45°, with the horizontal, as shown in broken lines in FIG. 2. This permits the cushion to adapt itself more perfectly to the shape of the seats on which it is most likely to be placed when in use. Thanks to its geometry and in particular to its wedge-like cross-section, the cushion, when placed on the seat e.g. of a chair or armchair and in contact with the back thereof, provides a slanted surface for supporting the back of the user.

Figure 4:
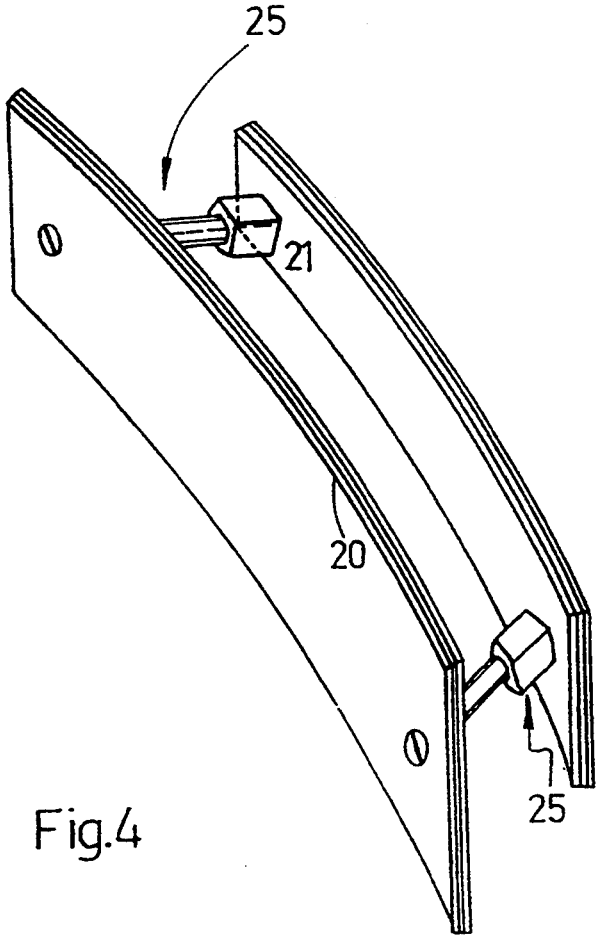
FIG. 4 is an exploded perspective view of the inner structure of a cushion according to a second embodiment of the invention.
Figure 5:
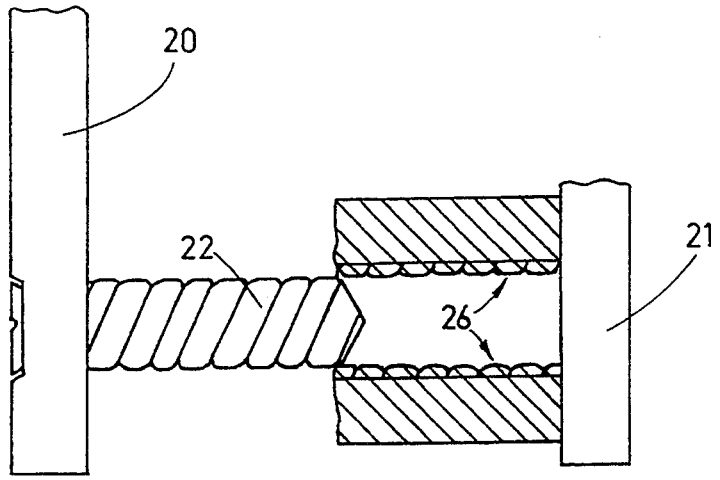
FIG. 5 is an axial cross-section of an element of the structure of FIG. 4.

According to another preferred embodiment of the invention, the inner structure of which is illustrated in FIGS. 4 and 5 (the front element of elastic material and the cover being omitted as they may be similar to those of the previously described embodiment) the wedge-shape of the cushion is determined by the cooperation of a backbone 20, similar to backbone 10 of FIGS. 1 to 3, with a spacer element 21. Said spacer should preferably be of essentially rigid material, like the backbone, and means should be provided connecting it with the backbone in such a way that the distance between the two can be changed to accommodate the requirements of the individual user. One such means is illustrated in FIG. 4, and consists of two or more rods 25, one of which is shown in cross-section in FIG. 5. Rods 25 are directly connected to spacer 21. The distance between the skeleton 20 and rigid element 21 is determined by simply screwing screws 22, the head of which point towards the back of the user, but are placed in fillister planes so that they do not protrude from the skeleton 20. The loose engagement of the heads of said screws into the fillister planes permit the backbone to change its slant as a result of the adjustment: The overall geometry of the cushion of this embodiment will preferably be within the limits set forth in describing the first embodiment.

Figure 6:
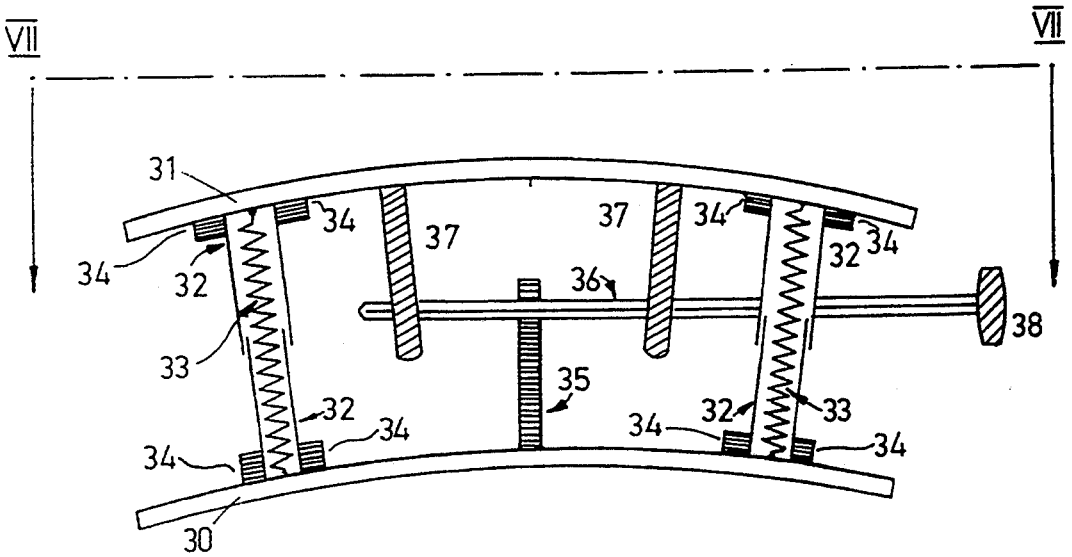
FIG. 6 is a cross-section of the inner structure of a third embodiment of the invention in a plane perpendicular to its front surface.
Figure 7:
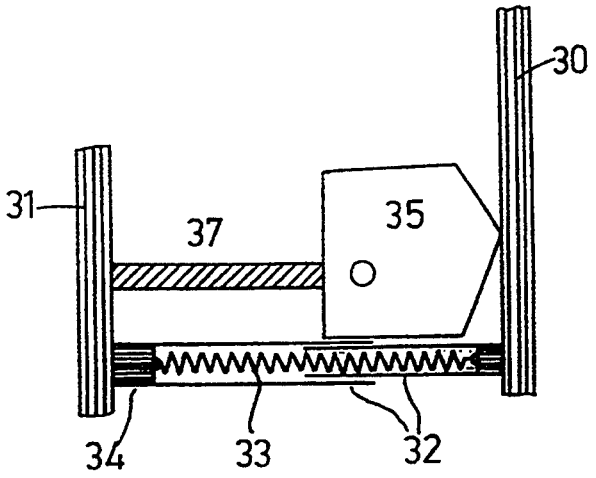
FIG. 7 is a cross-section of the embodiment of FIG. 6, taken on plane VII—VII of FIG. 6, perpendicular to the plane of said FIG. 6.
Figure 8:
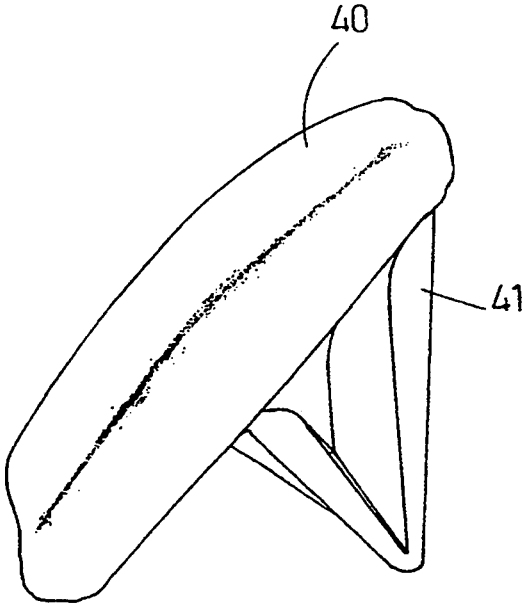
FIG. 8 illustrates in perspective view another, preferred embodiment of the invention.
Figure 9:
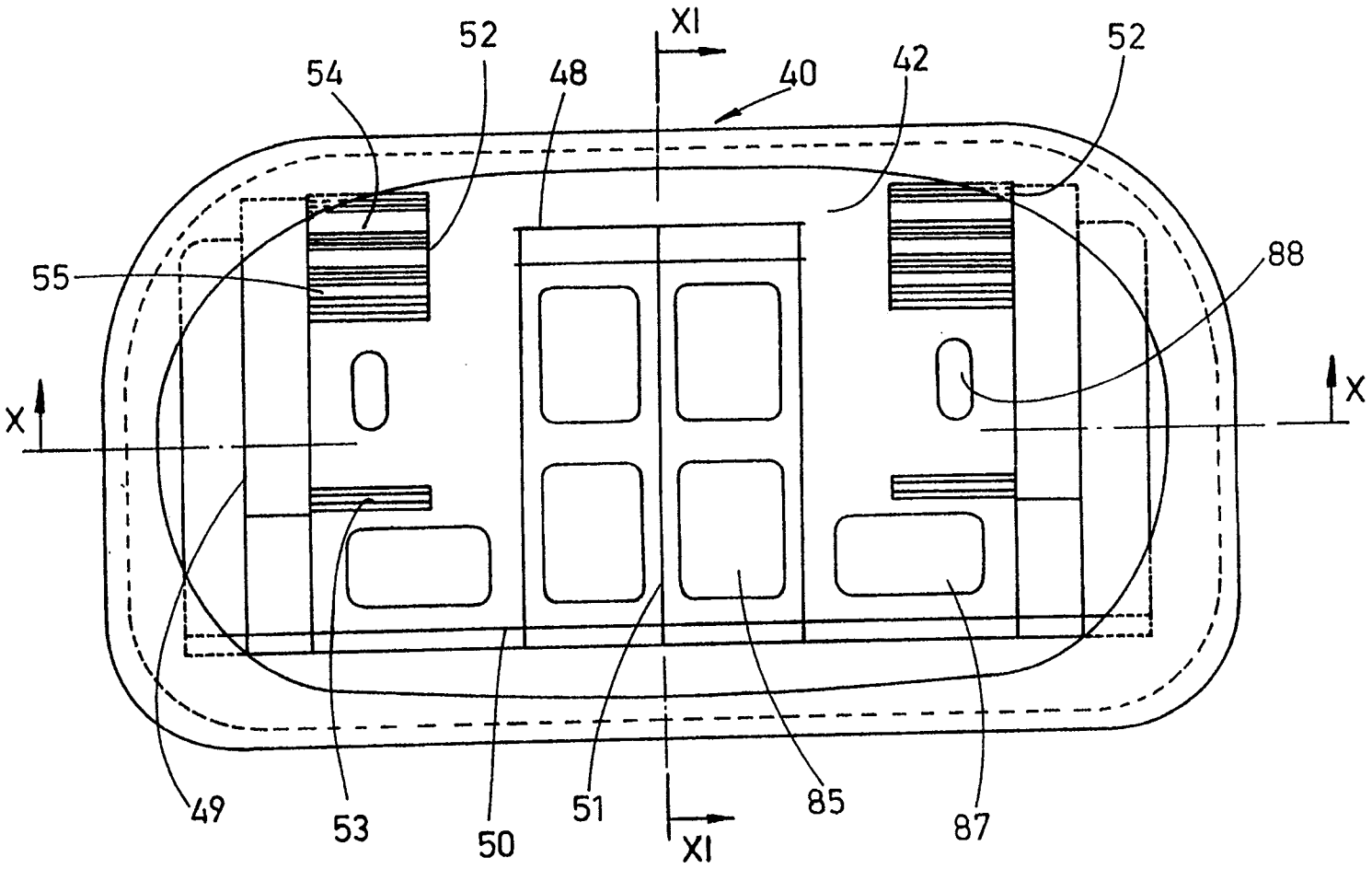
FIG. 9 is a rear view of the cushion assembly of the embodiment of FIG. 8.
Figure 10:
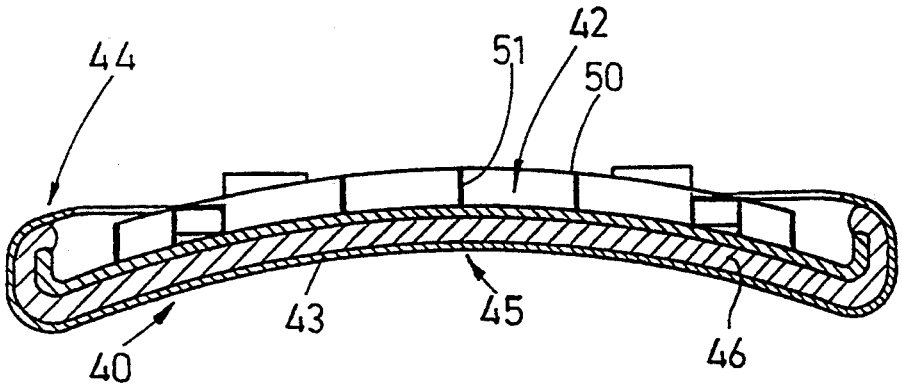
FIGS. 10 and 11 are cross-sections of the cushion assembly of FIG. 8 taken along the planes X—X and XI—XI of FIG. 9.
Figure 11:
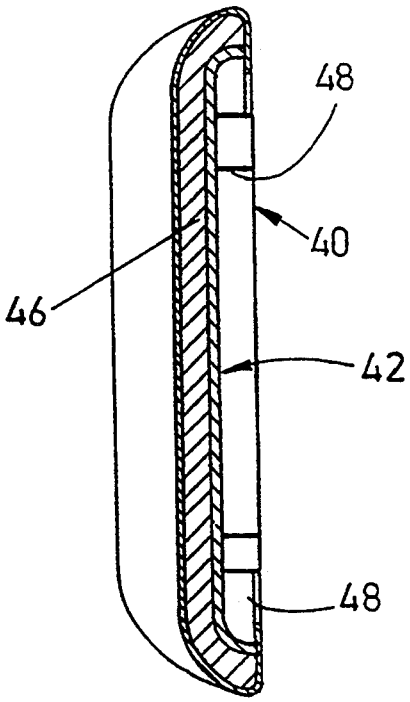

A third preferred embodiment of the invention, the inner structure of which is illustrated in FIGS. 6 and 7 (in which the front element and the cover, which are provided in the cushion, have been omitted for the sake of simplicity), is similar to that of FIGS. 4 and 5, but the means for varying the distance between skeleton 30 (similar to skeleton 20) and spacer 31 (similar to spacer 21 ) are different. The two elements are connected by two (or more) sliding cylinders 32, to which springs 33 are associated, and which are connected through blocks 34 to the backbone 30 and to the spacer 31. The springs tend to draw the skeleton and spacer the one towards the other. The distance between them is determined by a cam 35 mounted on a shaft 36 supported in two bars 37 and provided with a handle 38 for rotating it. The cam is eccentrically mounted on shaft 36 and has the shape of a polygon, as seen in FIG. 7. The distance of the backbone from the spacer is determined by the side of the polygon that contacts the backbone 30. When the distance of said side from the axis of shaft 36 decreases, the backbone is urged backwards by springs 33, which slide either inside or outside (not shown here) cylinders 32, and will shift backwards as far as the cam will permit. Thus the width of the cushion at the level of shaft 36 is adjusted and its geometry changes accordingly. No rear element is required, except the spacer, either in this embodiment or in that of FIGS. 4 and 5, but could optionally be added. A further preferred embodiment of the invention is illustrated in FIGS. 8 to 16. This embodiment comprises a cushion assembly, indicated at 40, and a foldable rear support indicated at 41. The cushion assembly, as seen in cross-section in FIGS. 10 and 11, comprises a backbone 42, curved in a horizontal cross-section, viz. a cross-section perpendicular to its front surface, similarly to backbones 10 and 20. The cushion assembly 40 is provided with a front element which, in this particular embodiment, is illustrated as comprising an elastic sheet, e.g. of polyurethane foam, 46, and an outer cover 43 which is preferably elastic or provided with an elastic border and overlaps the backbone 42, as shown at 44, and holds the elastic sheet 46 in place on said backbone. As is shown in FIG. 9, backbone 42 may be provided with openings such as 85, 87 and 88 for the purpose of lightening it and providing aeration, but said openings are not essential. It may also be provided with stiffening ribs 48, 49, 50 and 51, but these, too, are not essential. Backbone 42 is provided with anchoring grooves for the rear support. There are two groups each comprising a plurality of upper anchoring grooves 52, symmetrically located on the two sides of the plane of symmetry of the cushion assembly, which is the plane XI—XI of FIG. 9; and, in this embodiment, two lower anchoring grooves 53, symmetrically located on the two sides of the plane of symmetry of the cushion assembly. The lower anchoring grooves might be more than two and divided into two symmetric groups, and in that case two upper anchoring grooves might suffice. Grooves 52 and 53 are intended to be engaged by the top and the bottom of the rear support respectively, and are so distributed that they may provide different distances between the top and the bottom of the rear support. In the embodiment shown, there is a plurality, specifically four upper grooves 52, which are intended to be engaged by the top of the rear support on each side of the backbone, and a single groove 53 to be engaged by the bottom of the rear support on each side of the backbone. For a better adjustment of the device it has been found that it is desirable that the top grooves 52 be spaced not uniformly, but the distance between successive grooves decrease from the top to the bottom, as shown in the drawing, the greatest distance being shown at 54 and the samllest at 55. As noted, the relationship between the grooves could be inverted, or in other words, a single upper groove could be provided to cooperate with a plurality of lower grooves, or there could be several top grooves and bottom grooves as well.

Figure 12:
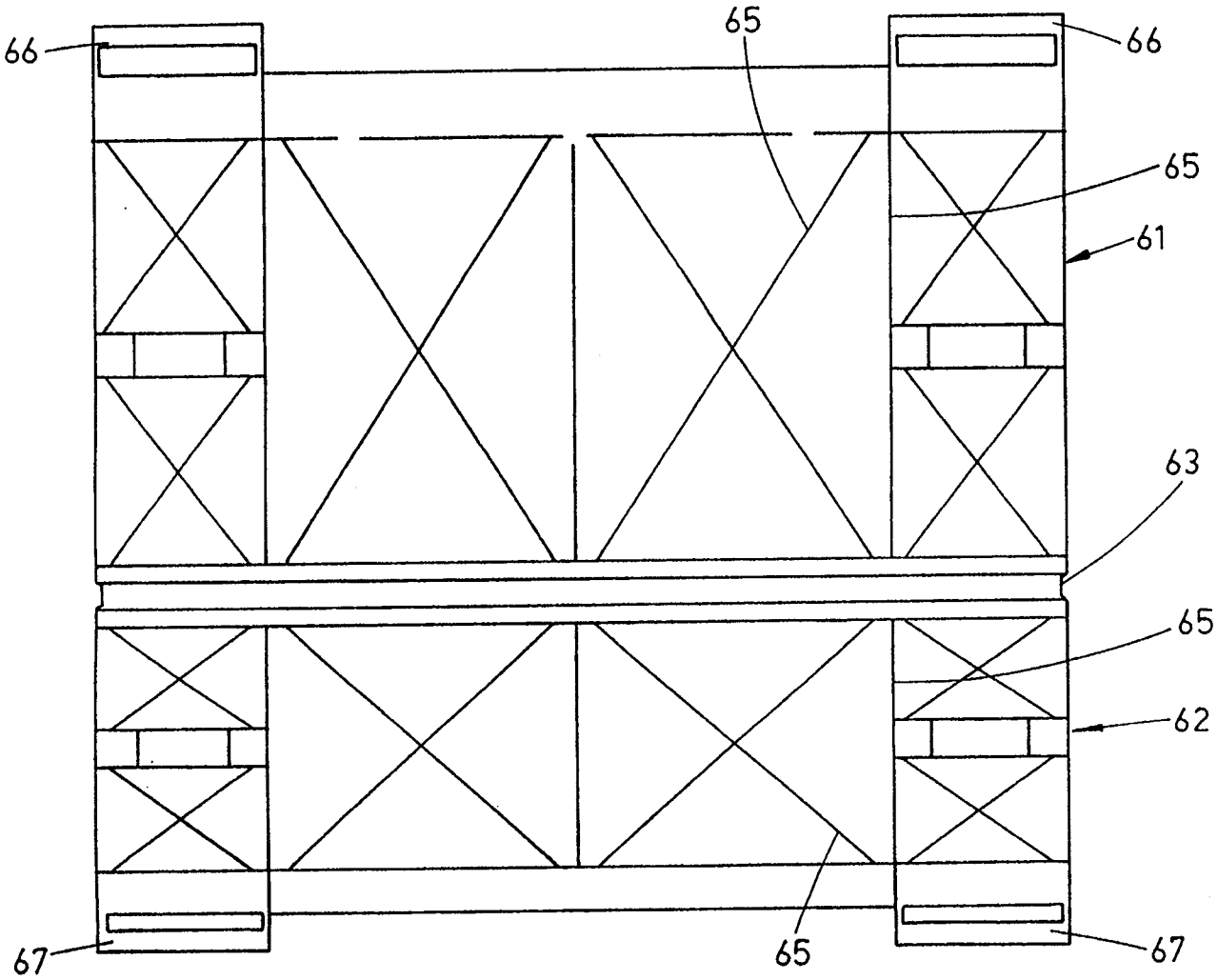
FIG. 12 is a view of the rear support of the embodiment of FIG. 8, shown in the open, distended position.
Figure 13:
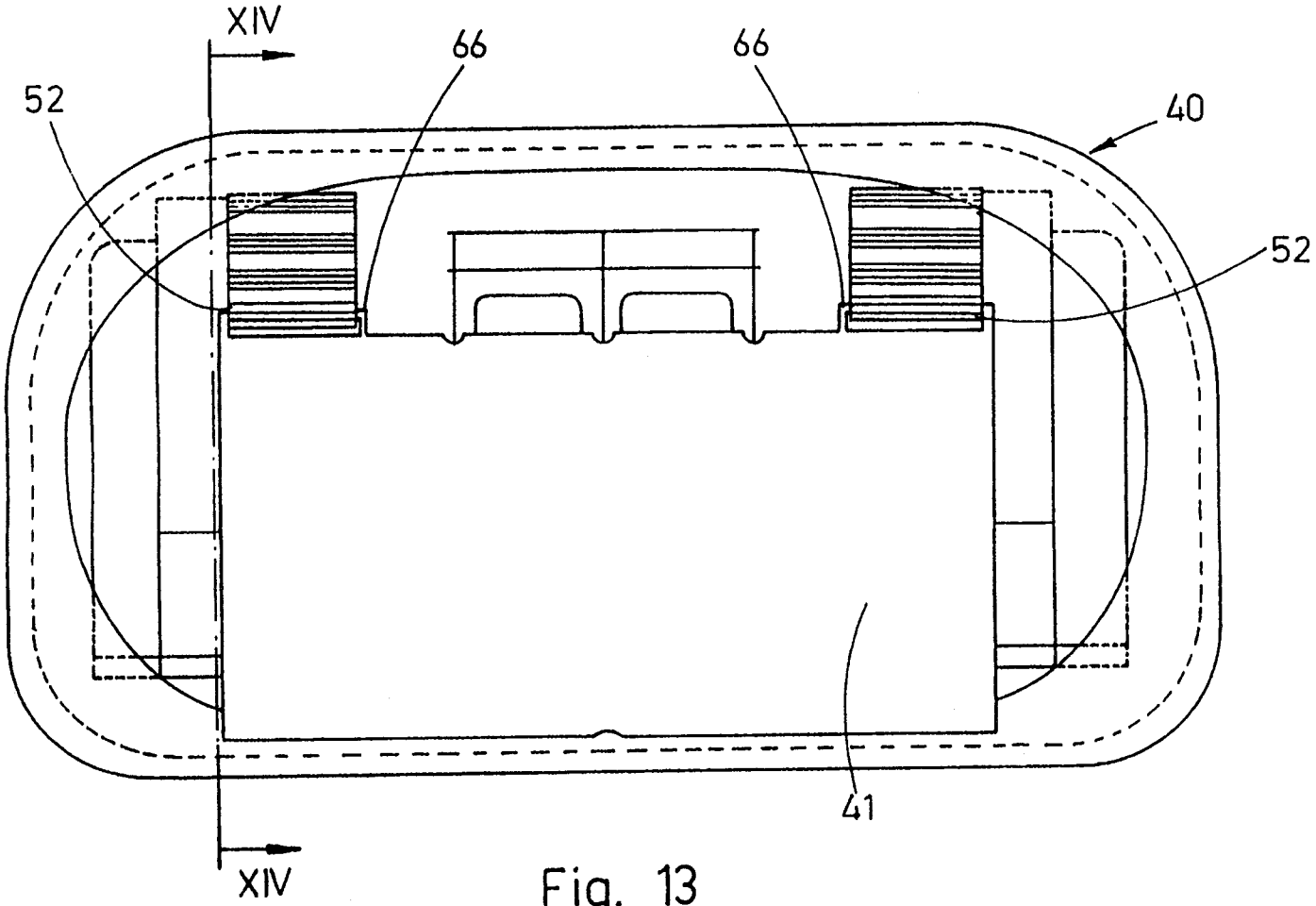
FIG. 13 is a view similar to FIG. 9 showing the complete cushion, with the rear support mounted on the cushion assembly.
Figure 14:
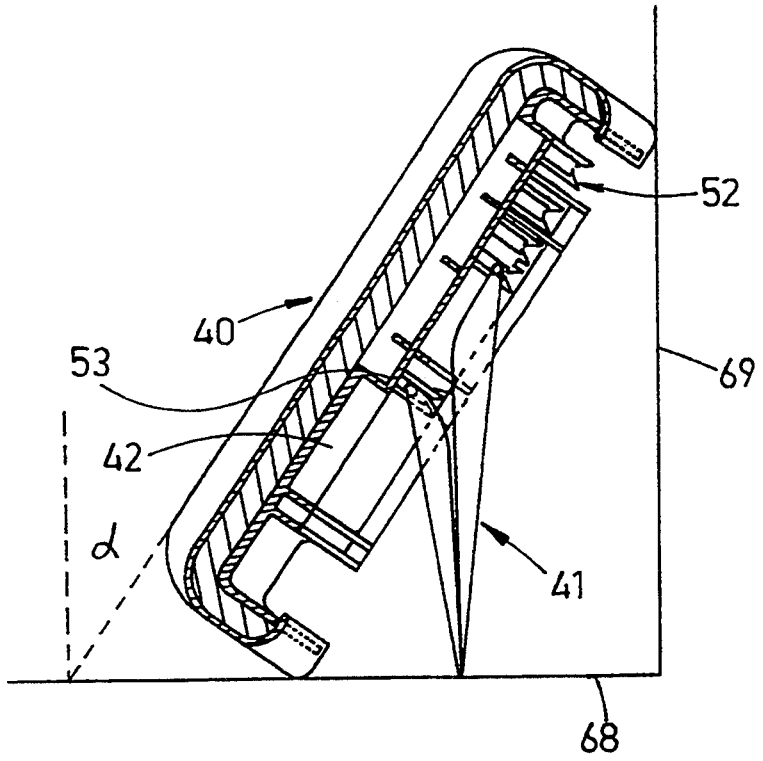
FIG. 14 is a cross-section of FIG. 13 taken on the plane XIV—XIV.
Figure 15:
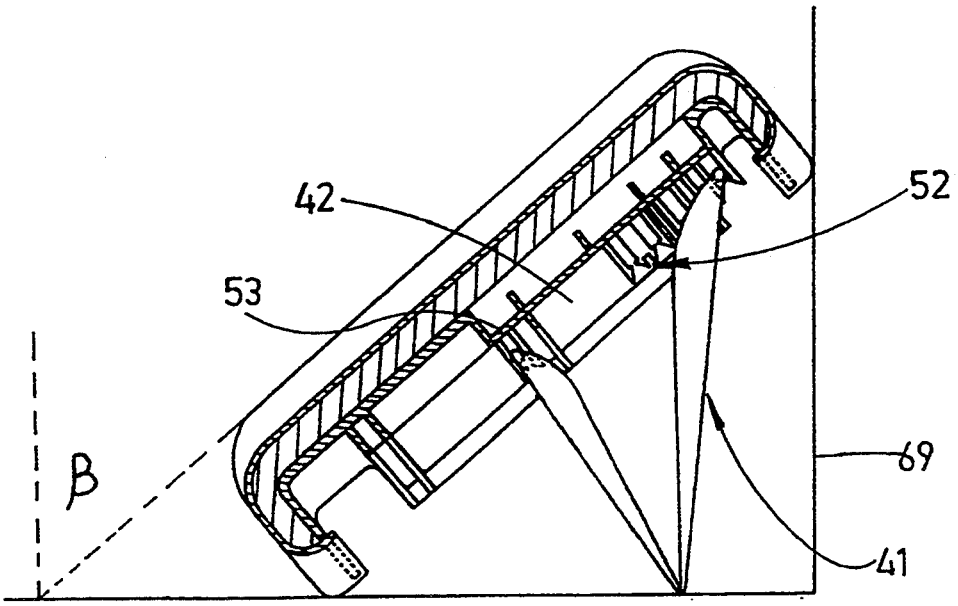
FIG. 15 is a cross-section similar to FIG. 14, but showing the cushion as it appears when the rear support is mounted different than in FIG. 14.
Figure 16:
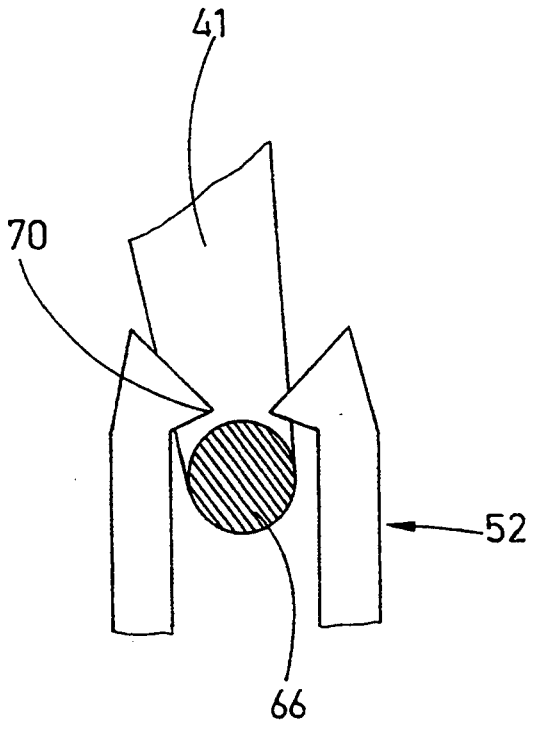
FIG. 16 is a detail of FIGS. 14 and 15.

The rear support, illustrated in FIG. 12, consists of an upper portion 61 and a lower portion 62, between which the plate is foldable about the intermediate zone 63. Portions 61 and 62 may be provided with stiffening ribs as generally indicated at 65 and are provided with means for engaging the anchoring grooves of the backbone. In this embodiment, said engaging means are anchoring bars adapted to be inserted into the aforesaid anchoring grooves and to be held therein in frictional and elastic snap-engagement. The upper portion of the rear support is provided with anchoring bars 66 and the lower portion is provided with anchoring bars 67. Anchoring bars 66 engage upper grooves 52 of the backbone, while lower anchoring bars 67 engage lower grooves 53. When the anchoring bars are engaged in their respective grooves, the rear support is bent about intermediate zone, its two portions forming an angle which depends on the particular upper groove 52 that has been chosen and in general on the distance between the upper and lower anchoring bars when these are engaged in their respective grooves. The assembled cushion appears from the rear as shown in FIGS. 13 and in cross-section (the rear support being shown in side view) in FIG. 14, in which the upper anchoring bars are shown as engaged in the lowermost upper groove of the backbone. The same position is illustrated in cross-section, similar to that of FIG. 14, in FIG. 15, in which another position of the rear support is illustrated, precisely the position which it assumes when the upper anchoring bars are engaged in the uppermost upper grooves of the backbone. In FIG. 14 the surface of the seat on which the cushion is placed when in use is indicated at 68. It is seen that the front of the cushion makes an angle $\alpha$ with a vertical. In FIG. 15 is seen that the front surface of the cushion makes an angle $\beta$ with a vertical. Angles intermediate between $\alpha$ and $\beta$ can be obtained by engaging intermediate upper grooves of the backbone with the upper anchoring bars. As seen in FIG. 16, the grooves 52–53 (only one groove 52 being shown, but all the others being identical) are so shaped and dimensioned that, when the bars 66–67 (only one bar 66 being shown, but all the others being identical) are inserted into the grooves, these latter yield elastically to some extent and then retain the bars, since they they are provided with inwardly directed projections 70, the distance between the tips of which is smaller than the diameter of the bars 66–67, but are sufficiently yieldable to permit the bars to be withdrawn without difficulty. In this way the cushion can be mounted and dismounted and/or adjusted in a very simple manner, and this by means of a simple and economical structure. The means for engaging the backbone with the rear support could however be modified by persons skilled in the art to obtain an equivalent or similar result.

The cushion having an adjustable rear support, such as that of FIGS. 8 to 16, has preferably the following dimensions: its front is from 15 to 60 cm wide and from 12 to 50 cm high and the angle which its surface makes with the vertical, or more accurately with the plane of the seat's back, indicated as $\alpha$ in FIG. 14 and $\beta$ in FIG. 15, is from 0 to 45 degrees depending on the position of the rear support. In the specific embodiment illustrated in said figures, however, the minimum value of said angle, when the anchoring bars are engaged in anchoring grooves, is that of the angle $\alpha$ of FIG. 14. However, the cushion can also be used by bending the lower portion of the rear support upwards and engaging the lower anchoring bars into the lower anchoring grooves, but without engaging the upper anchoring bars in any anchoring grooves. In that case the front surface of the cushion will be essentially vertical, but the rear support will behave as a spring-like element, elastically yielding about zone 63 to the the pressure of the user's back. The embodiments of FIGS. 1 to 7 have essentially the same dimensions. In the embodiment of FIGS. 1 to 3 the angle of the cushion front surface with the vertical is fixed and determined by the shape and dimensions of the rear element 12.

It should be noted, with reference to the geometry of the cushion, that the backbone is always cylindrical, specifically in the form of a sector of a cylinder, if the word "cylindrical" is attributed its broader geometrical meaning, viz, is understood to designate a surface defined by a straight line or segment (generatrix), which moves in a path defined by a line (directrix). If the directrix is an arc of a circle, the surface is (sector-)cylindrical in the narrower sense of the word. In any case, planes perpendicular to the front surface of the cushion are perpendicular to the generatrices of the cylindrical surface.

While four embodiments of the invention have been illustrated, it should be understood that the invention may be carried out in other ways and with many modifications and adaptations, as are within the capabilities of persons skilled in the art, without departing from its spirit or exceeding the scope of the appended claims.

I claim:

1. An orthopedic portable cushion, comprising:

a cushion assembly and a rear support;

the cushion assembly having a front outer surface adapted to come into contact with a user's back when the cushion is in use, and including an essentially rigid, stiffening backbone having a configuration that is essentially curved in cross-section in a plane perpendicular to said front outer surface of the cushion assembly, the backbone having spaced zones; and the rear support including an upper portion and a lower portion, foldable about a zone interposed between said two portions, and means being provided for removably connecting said two portions to spaced zones of said backbone.

2. An orthopedic portable cushion according to claim 1, wherein the spaced zones of the backbone are provided in pairs, the zones of each pair being symmetrically located with respect to a plane of symmetry of the front outer surface of the cushion assembly, the zones of each of said pairs being vertically spaced from the zones of the other pair and provided with seats, and said upper and lower portions of said rear support being provided with means for engaging said seats.

3. An orthopedic portable cushion according to claim 2, wherein a plurality of said seats is provided in at least one pair of the spaced zones, of the backbone and are selectively engageable by the engaging means of the rear support.

4. An orthopedic portable cushion according to claim 2, wherein the upper portion of the rear support has upper anchoring bars and the lower portion has lower anchoring bars, and the backbone has a rear face and in the rear face includes upper anchoring grooves and lower anchoring grooves located in the pairs of spaced zones of the backbone, the upper anchoring grooves being engaged by said upper anchoring bars of said upper portion of said rear support when the cushion is in use, and the lower grooves of the backbone being engaged by said lower anchoring bars of said lower portion of said rear support when the cushion is in use.

5. A cushion according to claim 2 wherein the backbone includes a plurality of vertically spaced upper grooves or lower grooves, the upper portion of the rear support has upper anchoring bars and the lower portion has lower anchoring bars, whereby the upper anchoring bars and the lower anchoring bars of the rear support may be differently spaced when the cushion is in use, by selecting which of said vertically spaced grooves are engaged by upper and lower anchoring bars.

6. A cushion according to claim 2, wherein the backbone includes the upper anchoring grooves and the lower anchoring grooves, the upper portion of the rear support has upper anchoring bars, the lower portion has lower anchoring bars, the upper and lower anchoring grooves elastically engage and retain the upper anchoring bars and the lower anchoring bars respectively.

7. An orthopedic portable cushion, comprising:

a cushion assembly and means for defining the geometry thereof in cross-section in a plane of symmetry, said means including a rear support;

the cushion assembly having a front outer surface adapted to come into contact with a user's back when the cushion is in use, and including an essentially rigid, stiffening backbone having a configuration that is essentially curved in cross-section in a plane perpendicular to said front outer surface of the cushion assembly, the backbone having spaced zones; and said rear support including an upper portion and a lower portion, foldable about a zone interposed between said two portions, and means being provided for removably connecting said two portions to spaced zones of said backbone.

* * * * *